US007866787B2

(12) United States Patent
Hiraki

(10) Patent No.: US 7,866,787 B2
(45) Date of Patent: Jan. 11, 2011

(54) MAINTENANCE UNIT FOR DROPLET EJECTING DEVICE

(75) Inventor: Nobuo Hiraki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 557 days.

(21) Appl. No.: 11/613,565

(22) Filed: Dec. 20, 2006

(65) Prior Publication Data

US 2007/0146414 A1 Jun. 28, 2007

(30) Foreign Application Priority Data

Dec. 28, 2005 (JP) ..... 2005-380151

(51) Int. Cl.
*B41J 2/165* (2006.01)

(52) U.S. Cl. ..... 347/22; 347/29

(58) Field of Classification Search ..... 347/29, 347/22

See application file for complete search history.

(56) References Cited

U.S. PATENT DOCUMENTS 5,726,692 A * 3/1998 Yamaguchi et al. ..... 347/23
6,273,546 B1 8/2001 Kobayashi et al.
6,286,930 B1 9/2001 Kobayashi et al.
2005/0195240 A1 9/2005 Hiraki

FOREIGN PATENT DOCUMENTS

| | | | |
|---|---|---|---|
| JP | H05-016375 | A | 1/1993 |
| JP | H10-211708 | A | 8/1998 |
| JP | 2002-095960 | A | 2/2002 |
| JP | 2002-127433 | A | 5/2002 |
| JP | 2003-094674 | A | 4/2003 |
| JP | 2005-246929 | A | 9/2005 |

* cited by examiner

*Primary Examiner*—Julian D Huffman
*Assistant Examiner*—Jason S Uhlenhake
(74) *Attorney, Agent, or Firm*—Baker Botts L.L.P.

(57) ABSTRACT

A maintenance unit for a droplet ejecting device, includes a base frame, a sealing unit, a guiding mechanism, and a supporting part. The sealing unit is capable of sealing nozzles. The guiding mechanism is capable of moving the sealing unit, in association with a reciprocating motion of a carriage between a first position in which the sealing unit seals the nozzles and a second position in which the sealing unit separates from the nozzles. The guiding mechanism includes a first engaging part and a second engaging part that are coupled to the sealing unit. The second engaging part is provided at a side closer to a droplet ejecting region than the first engaging part. The supporting part supports the sealing unit and is in a position either just, below the first engaging part or at a side farther from the droplet ejecting region than the first engaging part when the sealing unit is in the second position.

14 Claims, 16 Drawing Sheets

MAINTENANCE UNIT FOR DROPLET EJECTING DEVICE

CROSS REFERENCE TO RELATED APPLICATIONS

This application claims priority from Japanese Patent Application No. 2005-380151 filed Dec. 28, 2005. The entire content of priority application is incorporated herein by reference.

TECHNICAL FIELD

The present invention relates to a maintenance unit for a droplet ejecting device, and to a droplet ejecting device employing the maintenance unit.

BACKGROUND

An inkjet recording device well known in the art records print data on a recording paper by pressurizing ink in a pressurizing chamber to eject ink droplets from nozzles onto the recording paper. Many issues leading to printing inconsistencies can arise in this inkjet recording device, including viscosity build-up in the ink caused by ink solvent evaporating from the nozzles, the solidification of the ink, dust deposits, and air bubbles in the ink near the nozzles.

Therefore, this type of inkjet recording device normally has a maintenance unit including capping unit for sealing the nozzles in the recording head when not printing, and cleaning unit for cleaning a nozzle plate as needed.

For example, an ink jet recording device includes a capping unit disposed outside a printing range and including a cap that moves from a standby position to a contact position when pressed by a recording head or a carriage supporting the recording head, and a four-joint parallel linkage mechanism for moving the cap toward the nozzle plate side of the recording head as the recording head moves from the standby position to the contact position.

As shown in FIG. 1A, this capping unit 340 is configured of a cap 341 that moves vertically to seal or separate from the nozzles, a capping base 311 for supporting the cap 341, and the four-joint parallel linkage mechanism 342 for rotatably linking the cap 341 to the capping base 311. A receiving plate 344 is provided on an end portion of the cap 341 for receiving contact from the recording head 310 or carriage that pushes the cap 341.

The linking mechanism 342 includes two link members 342*a* and 342*b* with engaging holes formed on both ends thereof. An end of each link member 342*a* and 342*b* is pivotably fixed to the capping base 311, while the other end of each link member 342*a* and 342*b* is pivotably fixed to the cap 341.

As shown in FIG. 1A, a cap support part 312 is provided on the capping base 311. The cap support part 312 supports the cap 341 at a point leftward of the point at which the link member 342*a* in the linking mechanism 342 is engaged when the cap 341 is in the standby position, i.e. before the recording head 310 contacts the receiving plate 344 provided on the cap 341.

With this construction, the right end of the recording head 310 contacts the receiving plate 344 when the recording head 310 moves outside the printing range (toward the right in FIG. 1A). Moving farther rightward from this state, the recording head 310 pushes against the receiving plate 344 so that the cap 341 is lifted and rotated about the points on the capping base 311 to which the linking mechanism 342 is fixed, while maintaining a nozzle sealing surface (a top surface) of the cap 341 parallel to a bottom surface 310A of the recording head 310. As the cap 341 is raised, the nozzle sealing surface seals the nozzles formed in the bottom surface 310A of the recording head 310.

Conversely, when the recording head 310 moves toward the printing area (leftward in FIG. 1A), the recording head 310 no longer applies pressure to the receiving plate 344. Consequently, a spring (not shown) engaged to a lower left end of the cap 341 and the capping base 311 urges the cap 341 to return to the standby position.

SUMMARY

However, when moving the cap 341 vertically to seal the nozzles in the recording head 310, as described above, a sufficient stroke (where L is a length of a stroke and will be referred to as the stroke L hereafter) must be provided for the vertical movement of the cap 341 in order to prevent the cap 341 from impeding the movement of the recording head 310 and to press the cap 341 against the nozzles in a direction orthogonal to a droplet ejecting direction.

One method of obtaining this stroke L is to shorten link member length of the four-joint parallel linkage mechanism 342 and to reduce a height of the cap 341 support part 312 formed on the capping base 311 in order to reduce angle $\alpha$ in the four-joint parallel linkage mechanism 342 at the standby position. In other words, the four-joint linkage mechanism 342 is laid downward.

However, as illustrated in FIG. 1A, when the recording head 310 presses against the receiving plate 344 in this method, an upward pulling force is applied to the link member 342*b* in the four-joint parallel linkage mechanism 342, while a downward pushing force is applied to the link member 342*a*. Consequently, in some cases the cap 341 tilts about the cap support part 312 formed on the capping base 311, as indicated by the dotted line in FIG. 1A, preventing the cap 341 from moving properly up and down.

In order to avoid this problem, link members 442*a* and 442*b* of a four-joint parallel linkage mechanism 442 may be increased in length, as illustrated in FIG. 1B, while increasing a height of a cap support part 412 formed on the capping base 311 in order to increase angle $\beta$ in the four-joint parallel linkage mechanism 442 at the standby position. In other words, the four-joint parallel linkage mechanism 342 is arranged in an erect state. When the recording head 310 presses against the receiving plate 344 in this construction, an upward pulling force is added to both link members 442*a* and 442*b* constituting the four-joint parallel linkage mechanism 442, thereby preventing a tilt in the cap 341.

However, since the length of the link members 442*a* and 442*b* are increased with this method, vertical dimension of the linkage mechanism 442 is increased, necessitating an increased size in the maintenance unit. In turn, this leads to an increased size in the inkjet printer.

In view of the foregoing, it is an object of the present invention to provide a maintenance unit for a droplet ejecting device that is compact and capable of reliably capping the recording head.

To achieve the above and other objects, one aspect of the invention provides maintenance unit for a droplet ejecting device including a base frame, a sealing unit, a guiding mechanism, and a supporting part. The sealing unit is provided on the base frame and capable of sealing nozzles formed in a droplet ejecting head mounted on a carriage. The carriage reciprocates between a droplet ejecting region for ejecting droplets from the nozzles in the droplet ejecting head onto a recording medium and a maintenance region for cleaning the nozzles in the droplet ejecting head. The sealing unit being located on the maintenance region. The guiding mechanism is interposed between the base frame and the sealing unit and capable of moving the sealing unit in association with a reciprocating motion of the carriage between a first position in which the sealing unit seals the nozzles and a second position in which the sealing unit separates from the nozzles. The guiding mechanism includes a first engaging part and a second engaging part. The first and second engaging parts are coupled to the sealing unit. The second engaging part is provided at a side closer to the droplet ejecting region than the first engaging part. The first and second engaging parts are movable according to positions of the sealing unit. The supporting part supports the sealing unit and is interposed between the sealing unit and the base frame. The supporting part is in a position either just below the first engaging part or at a side farther from the droplet ejecting region than the first engaging part when the sealing unit is in the second position.

In another aspect of the invention, there is provided droplet ejecting device including a droplet ejecting head, a carriage, a recording medium moving unit, and the maintenance unit described above.

In another aspect of the invention, there is provided a maintenance unit for a droplet ejecting device, including a sealing unit, and a guiding mechanism. The sealing unit is capable of sealing nozzles formed in a droplet ejecting head mounted on a carriage. The carriage reciprocates between a droplet ejecting region for ejecting droplets form the nozzles in the droplet ejecting head onto a recording medium and a maintenance region for cleaning the nozzles in the droplet ejecting head. The sealing unit is located on the maintenance region. The guiding mechanism is capable of moving the sealing unit in association with a reciprocating motion of the carriage between a first position in which the sealing unit seals the nozzles and a second position in which the sealing unit separates from the nozzles. The sealing unit includes a contact portion upon which the carriage impinges when the carriage moves from the droplet ejecting region to the maintenance region. The contact portion is configured to apply pushing force to the sealing unit in a direction from the second position to the first position when the carriage impinges upon the contact portion and apply push force thereupon.

In another aspect of the invention, there is provided droplet ejecting device including a droplet ejecting head, a carriage, a recording medium moving unit, and the maintenance unit described above.

DETAILED DESCRIPTION

Next, a droplet ejecting device according to preferred embodiments of the present invention will be described while referring to the accompanying drawings. The droplet ejecting device of the present invention is applied to an inkjet printer.

First Embodiment

Next, a first embodiment of the present invention will be described with reference to FIGS. 2 through 16.

<General Structure of an Inkjet Printer>

Figure 1A:
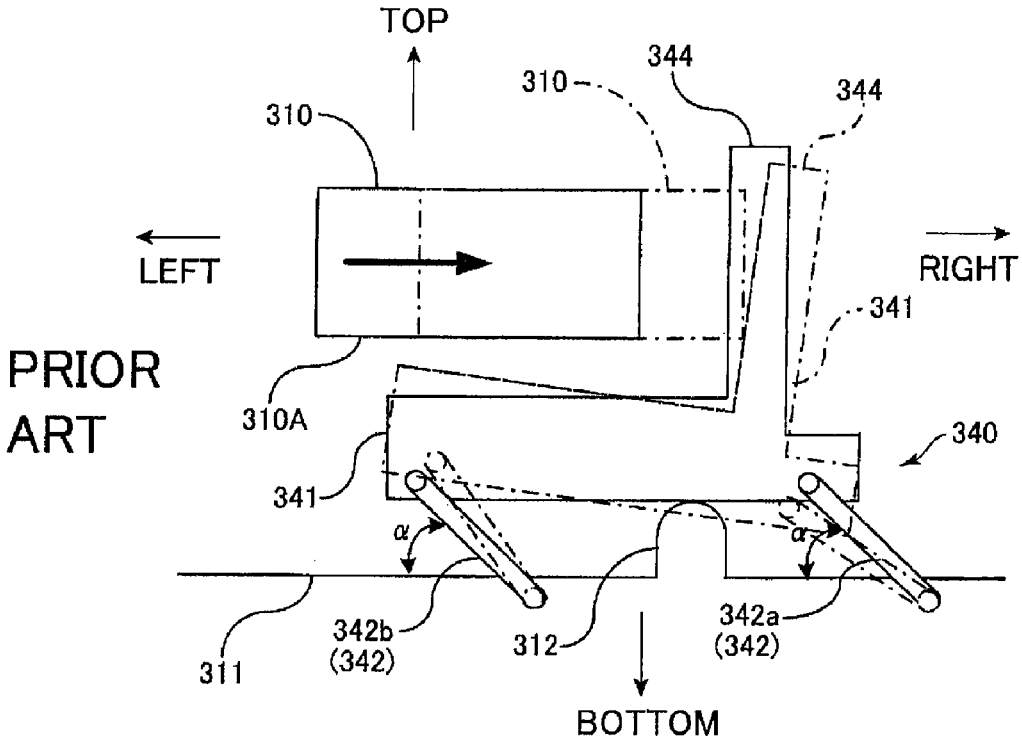
FIGS. 1A and 1B are schematic views illustrating a general structure and operations of conventional capping units.
Figure 1B:
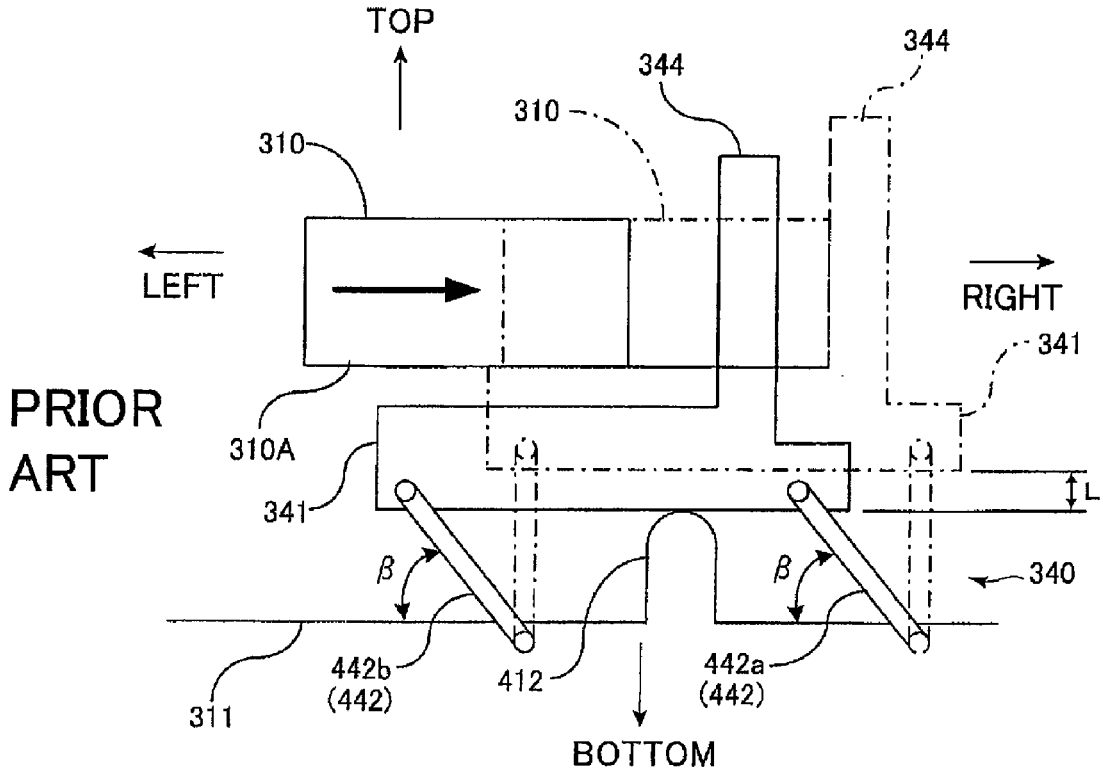
Figure 2:
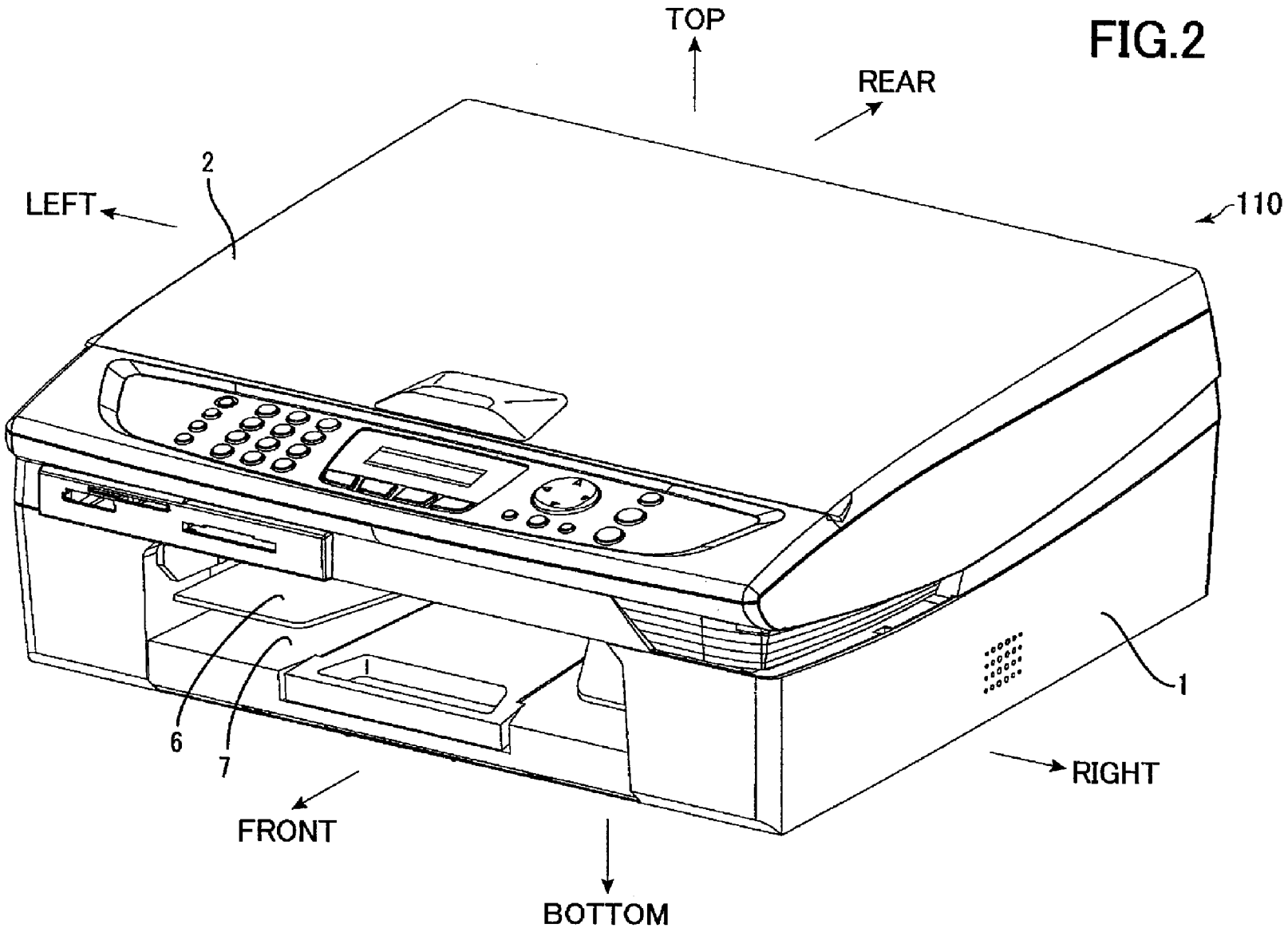
FIG. 2 is a perspective view showing an appearance of an inkjet printer including a maintenance unit according to a first embodiment of the present invention.
Figure 3:
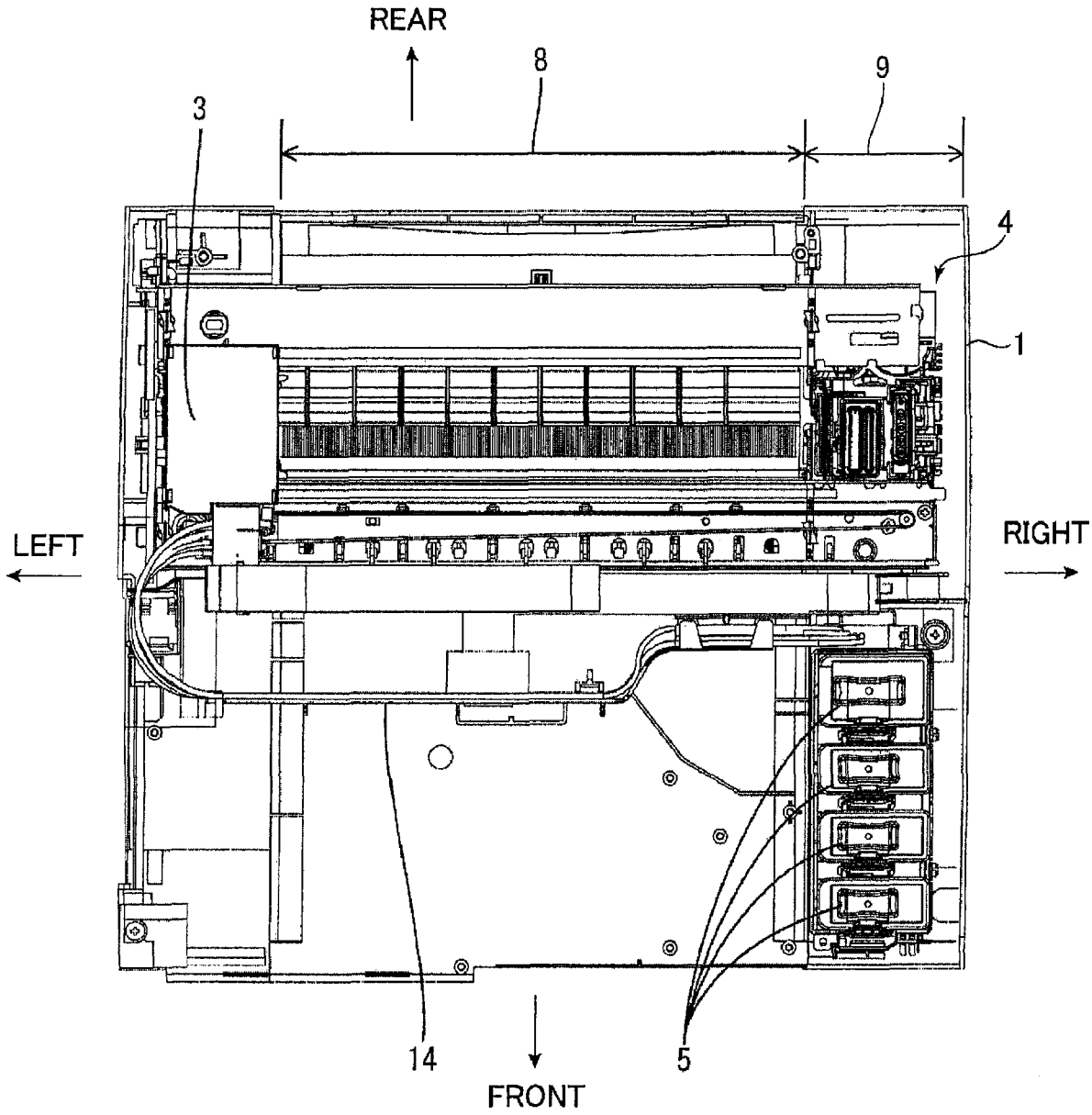
FIG. 3 is a plan view showing an overall configuration of internal mechanisms in the inkjet printer of FIG. 1.

First, the general structure of an inkjet printer 101 will be described with reference to FIGS. 2 and 3. FIG. 2 is a perspective view showing the appearance of the inkjet printer 101. FIG. 3 is a plan view showing the overall configuration of internal mechanisms in the inkjet printer 101.

The inkjet printer 101 of the preferred embodiment has a printer function, copier function, and scanner function. As shown in FIGS. 2 and 3, the inkjet printer 101 includes a body frame 1, a manuscript reading unit 2 disposed on a top surface of the body frame 1 for implementing the copier function and scanner function, a carriage 3 disposed beneath the manuscript reading unit 2, a maintenance unit 4 for removing obstructions in recording heads 10 described later, and ink tanks 5 for supplying ink to the recording heads 10.

A discharge tray 6 and a feeding tray 7 are provided in the front surface of the body frame 1. The carriage 3 is capable of reciprocating in the left-to-right direction, and a range in which the carriage 3 reciprocates from a left end of a reciprocating path to a position near a right end is a recording range 8. A region on a right end of the reciprocating path is a maintenance position 9, which may also be referred to as a point of origin or a home position of the carriage 3. The maintenance unit 4 is disposed in this maintenance position 9.

The ink tanks 5 (ink cartridges) provided for each of the colors black, cyan, magenta, and yellow are juxtaposed in front side of the maintenance position 9 toward the front of the inkjet printer 101 (the near side in FIG. 3).

<The Carriage and a Unit for Supplying Ink Thereto>

Figure 4:
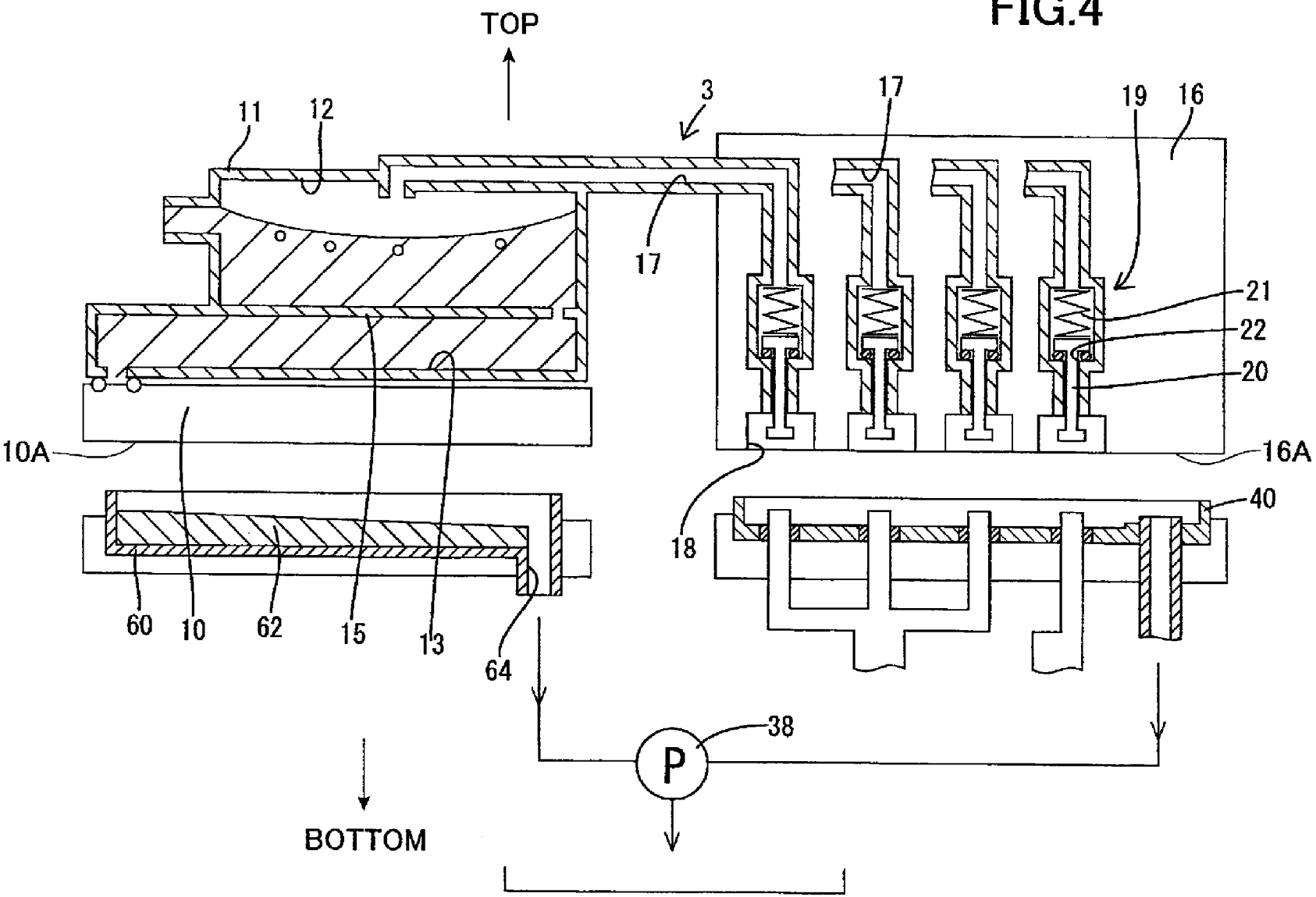
FIG. 4 is a schematic view of a carriage shown in FIG. 1.

Next, the carriage 3 and a unit for supplying ink to the carriage 3 will be described with reference to FIG. 4. FIG. 4 is a schematic view of the carriage 3.

The carriage 3 has four recording heads 10, although only one is shown in FIG. 4. A plurality of nozzles is formed in bottom surfaces 10A of the recording heads 10. Ink is ejected through the plurality of nozzles in a direction orthogonal to the bottom surface 10A of the recording head 10. The recording heads 10 eject ink downward through these nozzles as the carriage 3 reciprocates within the recording range 8, thereby printing images on paper or another recording medium.

A buffer tank 11 is provided on a top surface of each recording head 10. The buffer tank 11 has an air bubble retention chamber 12 in the top section thereof, and an ink chamber 13 in fluid communication with the recording head 10 provided in a bottom section thereof. Flexible tubes 14 (see FIG. 3) are provided for supplying ink to the air bubble retention chambers 12 from the ink tanks 5.

Ink supplied to each air bubble retention chamber 12 flows into the ink chamber 13 after passing through a filter 15 and is guided along the ink chamber 13 into the recording head 10. Air bubbles are filtered from the ink as the ink passes through the filter 15 and are retained in an upper region of the air bubble retention chamber 12.

A valve case 16 is provided in the carriage 3 to the front of the recording head 10. A discharge path 17 extends from an upper wall of each air bubble retention chamber 12 to a discharge opening 18 formed in a bottom surface 16A of the valve case 16. The four discharge openings 18 are formed on the bottom surface 16A of the valve case 16 and correspond to the four recording heads 10. The four discharge paths 17 extend vertically within the valve case 16. Shutoff valves 19 that are normally closed are housed in vertically extending sections of the discharge paths 17.

More specifically, each shutoff valve 19 includes a valve port 22, and a slender valve plug 20 extending vertically for plugging the valve port 22. A spring 21 urges the valve plug 20 into the valve port 22 so that the shutoff valve 19 is normally maintained in a closed state. The shutoff valve 19 can be opened by moving the valve plug 20 upward against an urging force of the spring 21.

<Drive Transmitting Mechanism for the Maintenance Unit>

Figure 5:
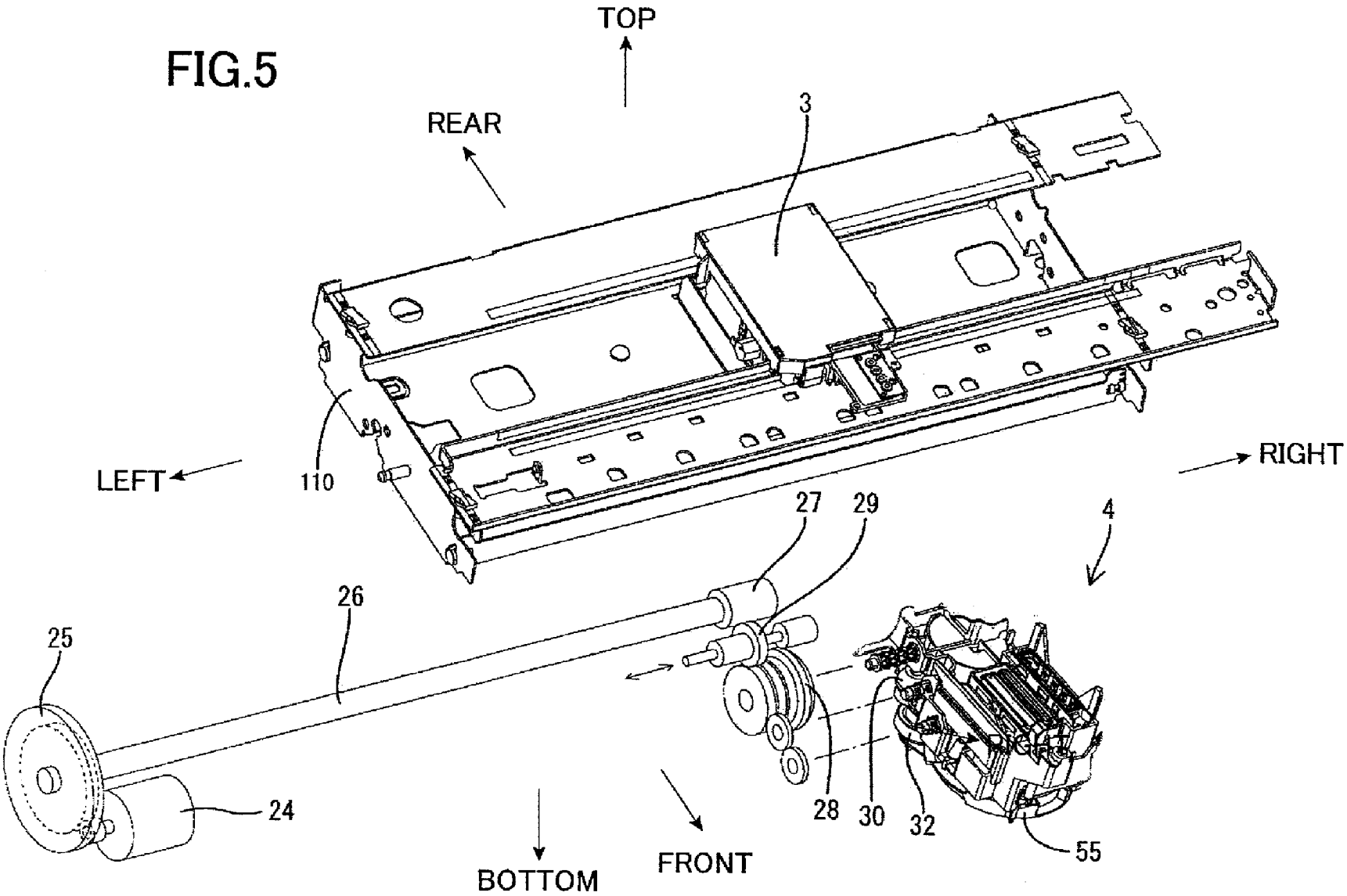
FIG. 5 is an exploded perspective view illustrating a structure for transmitting a rotational drive force to the maintenance unit according to the first embodiment of the present invention.
Figure 6:
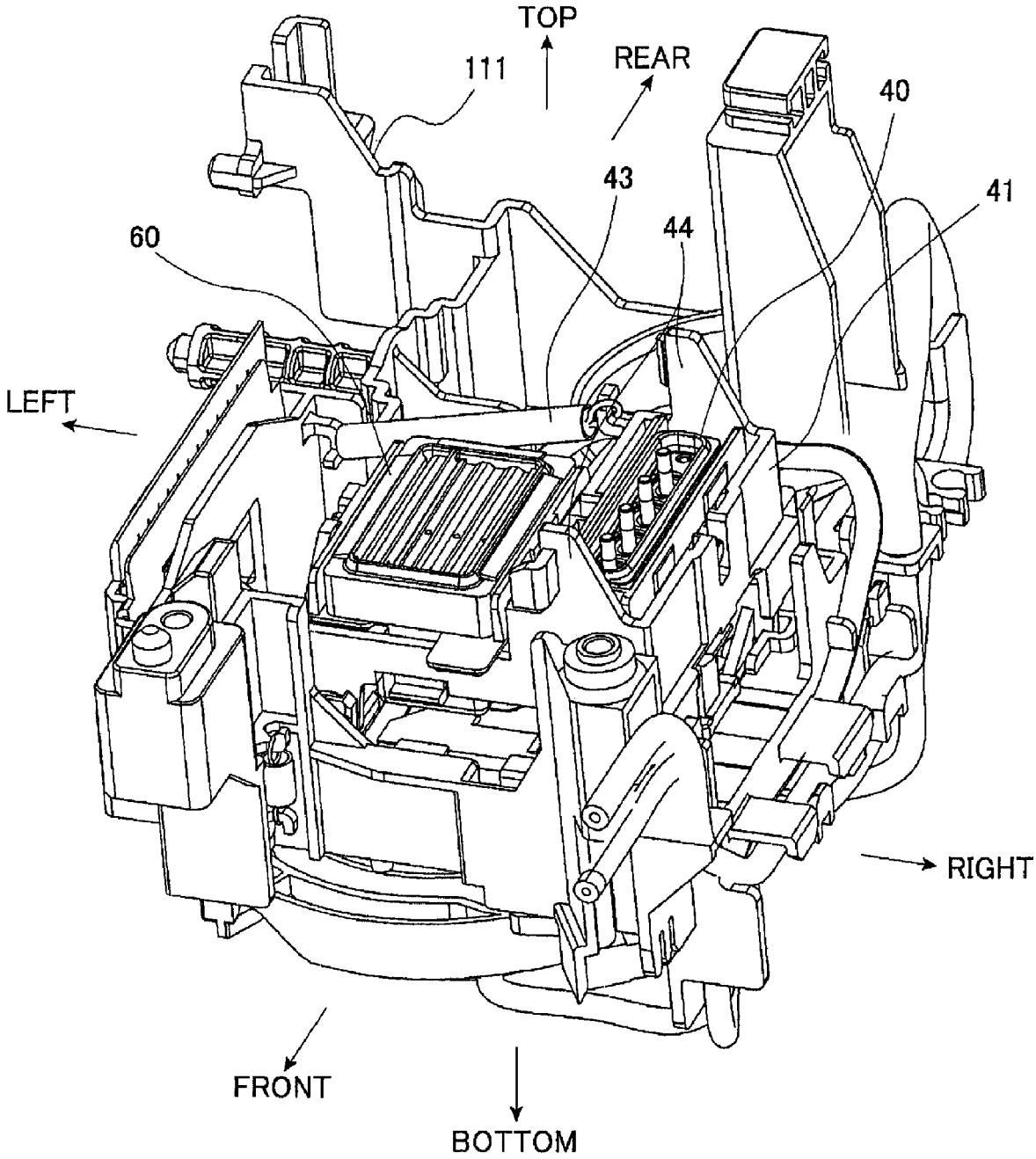
FIG. 6 is a perspective view showing an appearance of the maintenance unit according to the first embodiment of the present invention.
Figure 7:
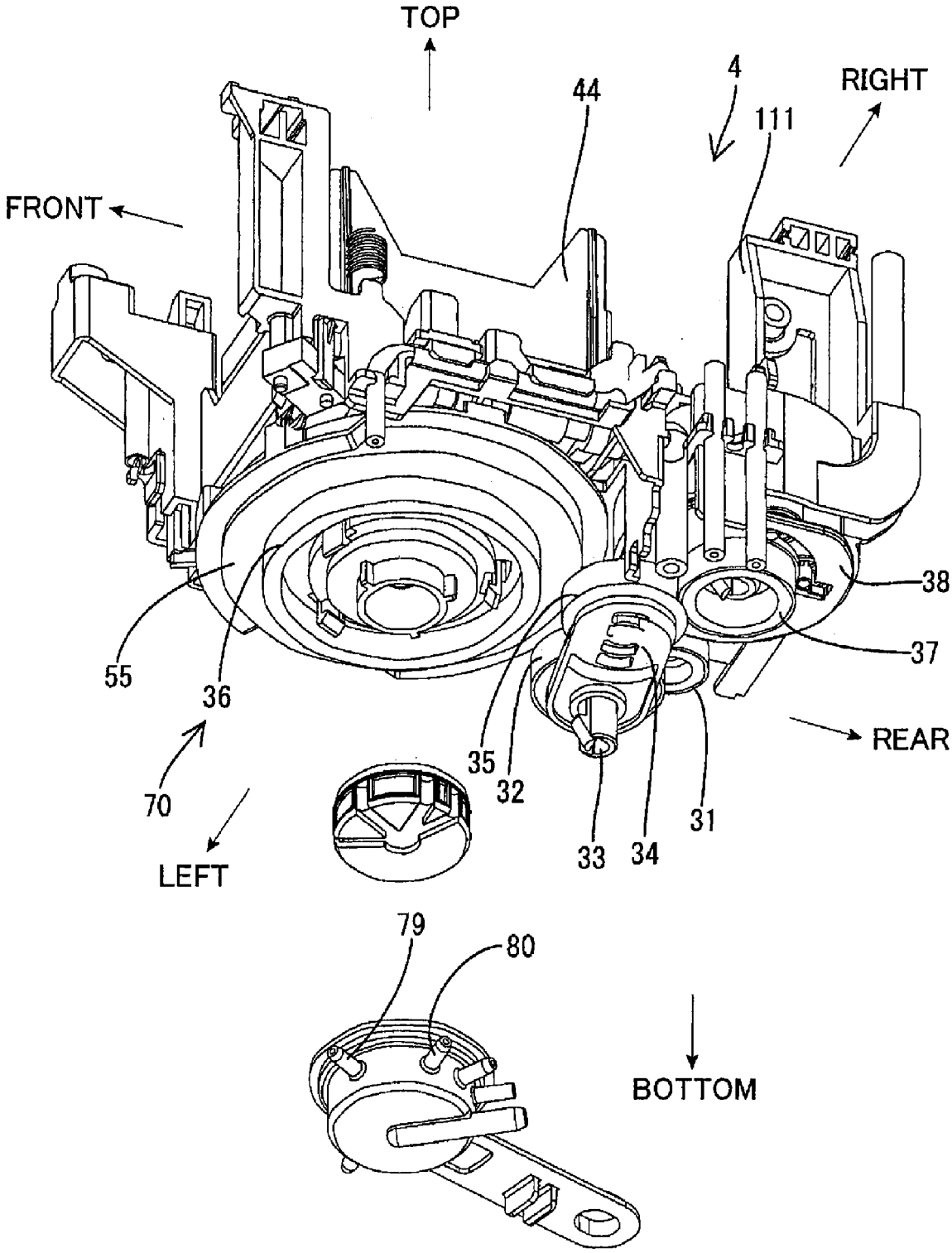
FIG. 7 is an exploded perspective view showing the maintenance unit of FIG. 5 from the bottom side.
Figure 8:
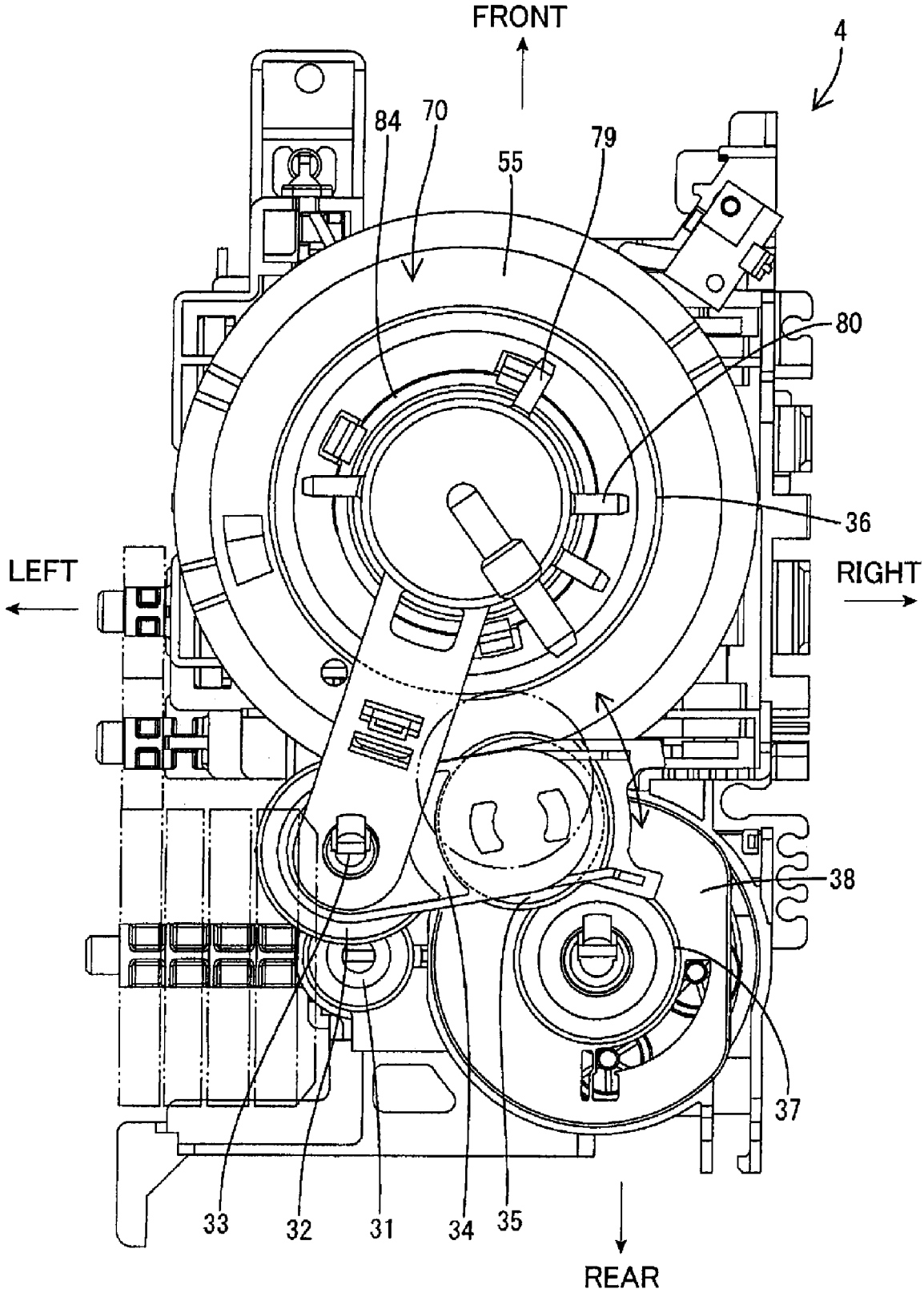
FIG. 8 is a bottom view of the maintenance unit shown in FIG. 5.

Next, a drive transmitting mechanism for the maintenance unit 4 will be described with reference to FIGS. 5-8. FIG. 5 is an exploded perspective view illustrating a structure for transmitting a rotational drive force to the maintenance unit 4. FIG. 6 is a perspective view showing an appearance of the maintenance unit 4. FIG. 7 is an exploded perspective view showing the maintenance unit 4 from the bottom side. FIG. 8 is a bottom view of the maintenance unit 4.

As shown in FIG. 5, the inkjet printer 101 has a carriage frame 110. A rotational driving mechanism including a motor 24 is provided on a left end of the carriage frame 110 for rotating sheet feeding rollers (not shown).

A reduction gear 25 is engaged with an output shaft of the motor 24. The reduction gear 25 is mounted on a rotational shaft 26 extending to the right. A drive gear 27 is provided on a right end of the rotational shaft 26 and is capable of rotating integrally therewith. A sliding gear 29 is engaged with the drive gear 27. The sliding gear 29 also engages with a large-diameter bevel gear 28 only when the carriage 3 moves into the maintenance position 9. The large-diameter bevel gear 28 engages with a small-diameter bevel gear 30, having a vertically oriented axis, in the maintenance unit 4.

The small-diameter bevel gear 30 is engaged with a solar gear 32 via a reduction gear 31 (see FIG. 7). As shown in the bottom views of the maintenance unit 4 in FIGS. 7 and 8, a swivel arm 34 is mounted at one end on a shaft 33 of the solar gear 32 and is capable of rotating relative to the shaft 33. A planetary gear 35 is rotatably mounted on the other end of the swivel arm 34. The planetary gear 35 is engaged with the solar gear 32.

A disc-shaped cam 55 is supported on the front side of the planetary gear 35 on a maintenance frame 111 so as to be freely rotatable. An axis of the cam 55 is vertically oriented and parallel to axes of the solar gear 32 and planetary gear 35. A driven gear 36 positioned at a same height as the planetary gear 35 in the vertical direction is integrally formed on the cam 55.

A pump gear 37 positioned at a same height as the planetary gear 35 in the vertical direction is supported on the maintenance frame 111 rearward of the planetary gear 35 so as to be freely rotatable. By rotating, the pump gear 37 drives a rotary pump 38 to execute a suction operation.

When the solar gear 32 rotates counterclockwise in FIG. 8, the planetary gear 35 rotates clockwise while revolving counterclockwise about the solar gear 32 and engages with the driven gear 36 of the cam 55. By rotating clockwise in this way, the planetary gear 35 drives the cam 55 to rotate counterclockwise (clockwise when viewed from above). Hence, the cam 55 always rotates in the counterclockwise direction of FIG. 8.

On the other hand, when the solar gear 32 rotates clockwise, the planetary gear 35 rotates counterclockwise while revolving clockwise about the solar gear 32 and engages with the pump gear 37. The planetary gear 35 drives the rotary pump 38 to rotate and perform a suction operation.

<A Cap Lift Holder of the Maintenance Unit>

Next, a cap lift holder 41 of the maintenance unit 4 will be described with reference to FIGS. 9-14.

Figure 9:
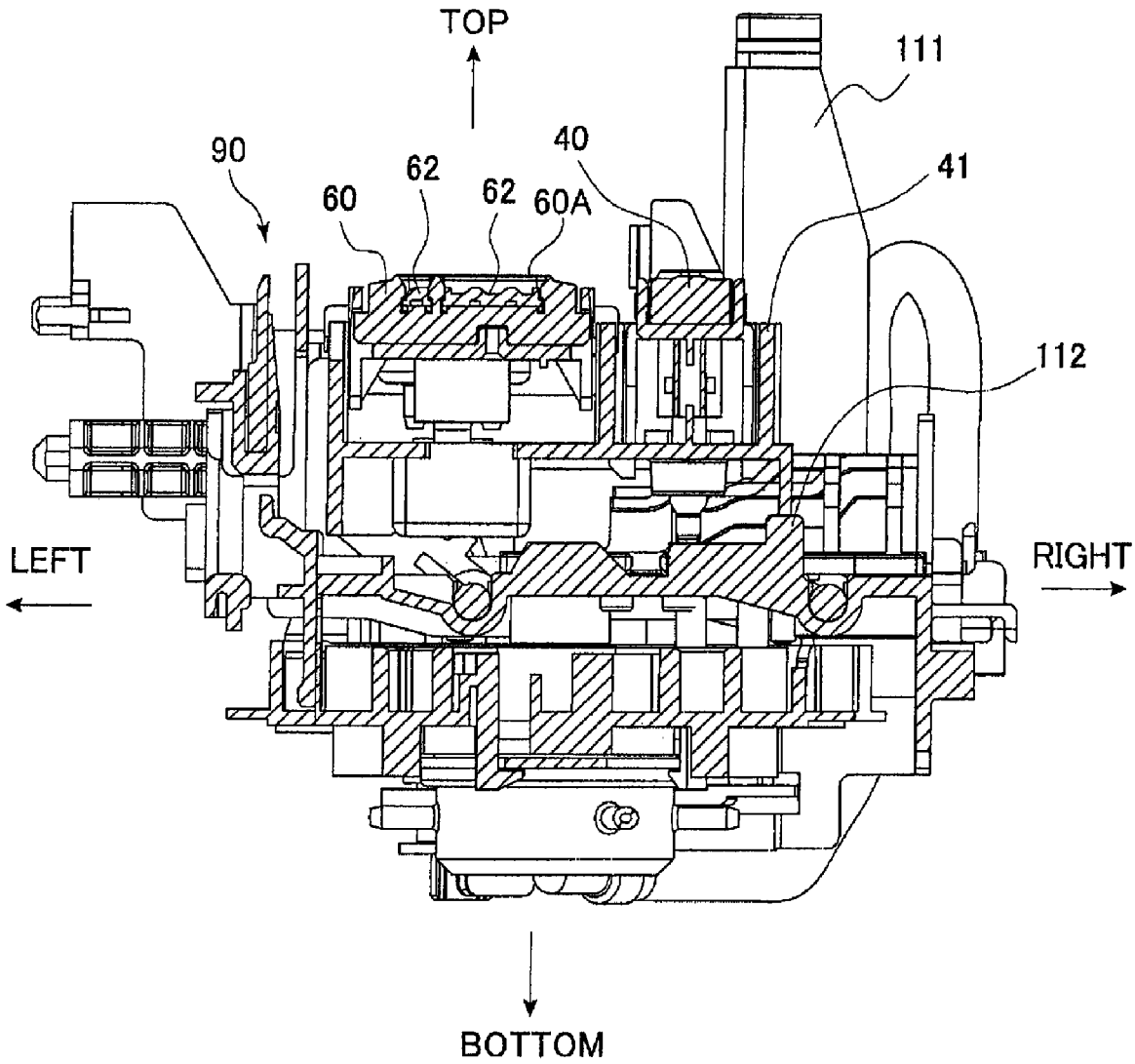
FIG. 9 is a cross-sectional view of the maintenance unit shown in FIG. 6, revealing a cap support part when a cap lift holder is in a standby position.
Figure 10:
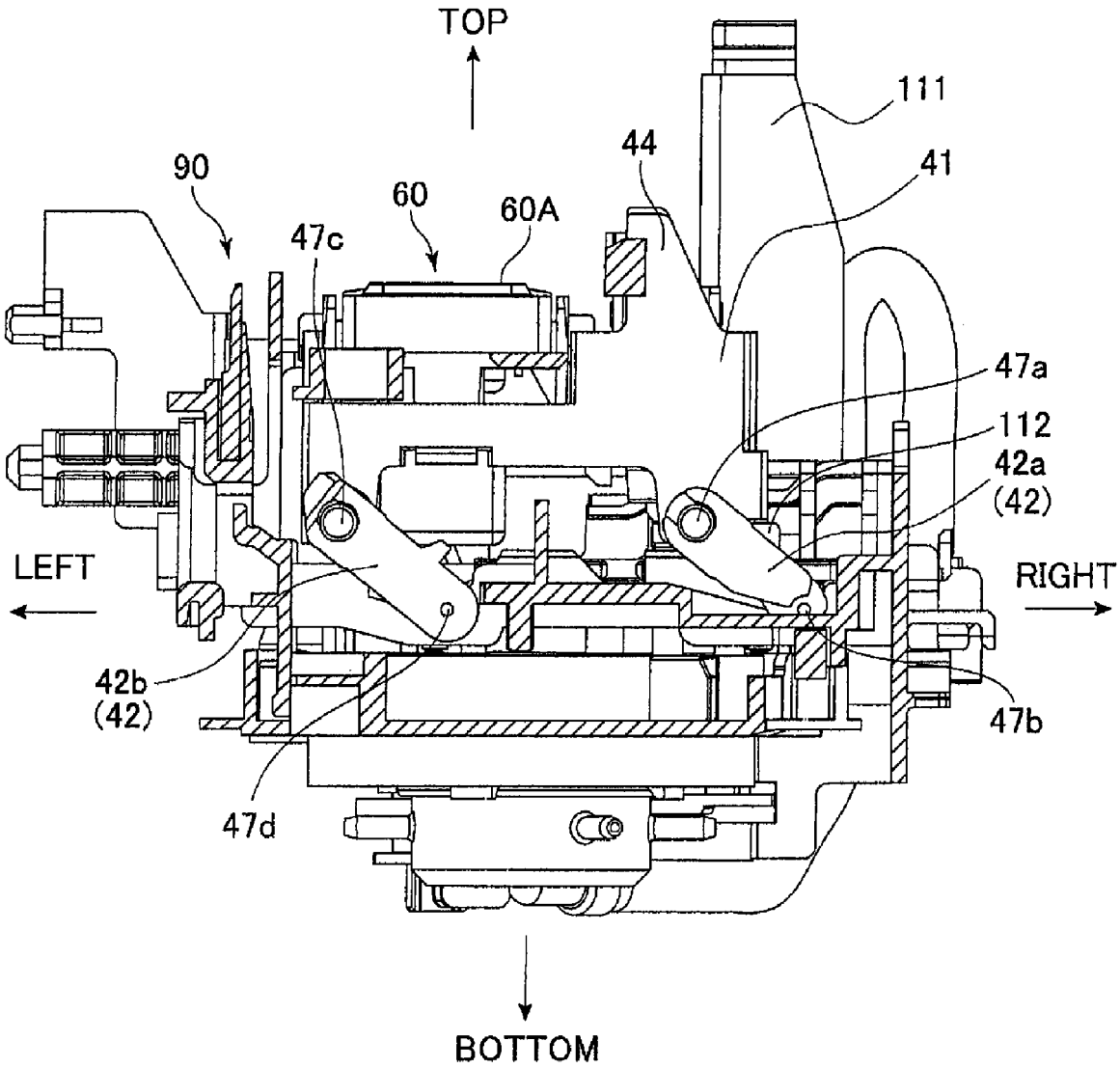
FIG. 10 is a cross-sectional view of the maintenance unit, revealing first and second link members when the cap lift holder is in the standby position.

FIG. 9 is a cross-sectional view of the maintenance unit 4 shown in FIG. 6, revealing a cap support part 112 when the cap lift holder 41 is in a standby position. FIG. 10 is a cross-sectional view of the maintenance unit 4 shown in FIG. 6, revealing first and second link members 42*a* and 42*b* when the cap lift holder 41 is in the standby position.

Figure 11:
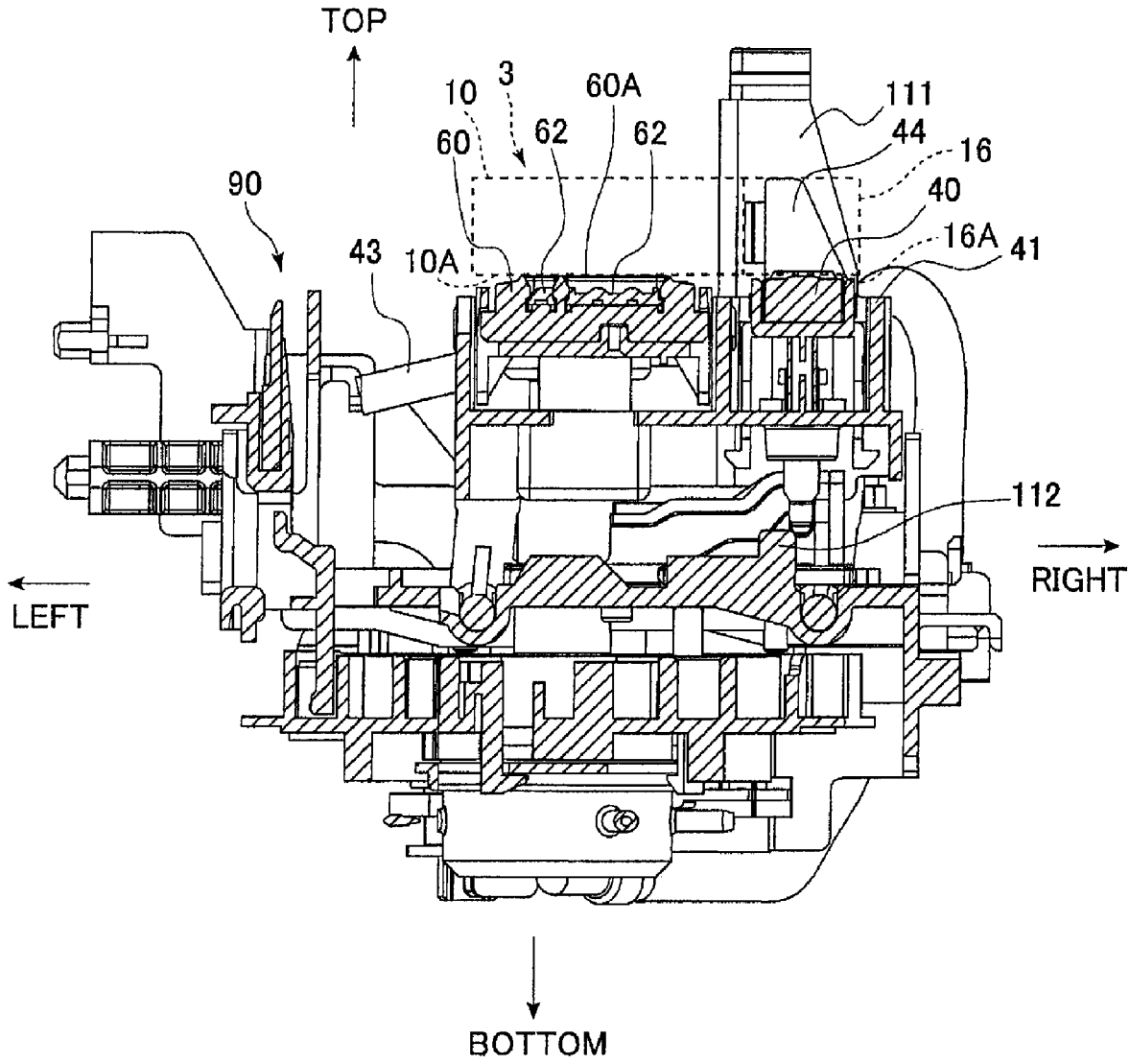
FIG. 11 is a cross-sectional view of the maintenance unit shown in FIG. 6, revealing a cap support part when the cap lift holder is in a contact position.
Figure 12:
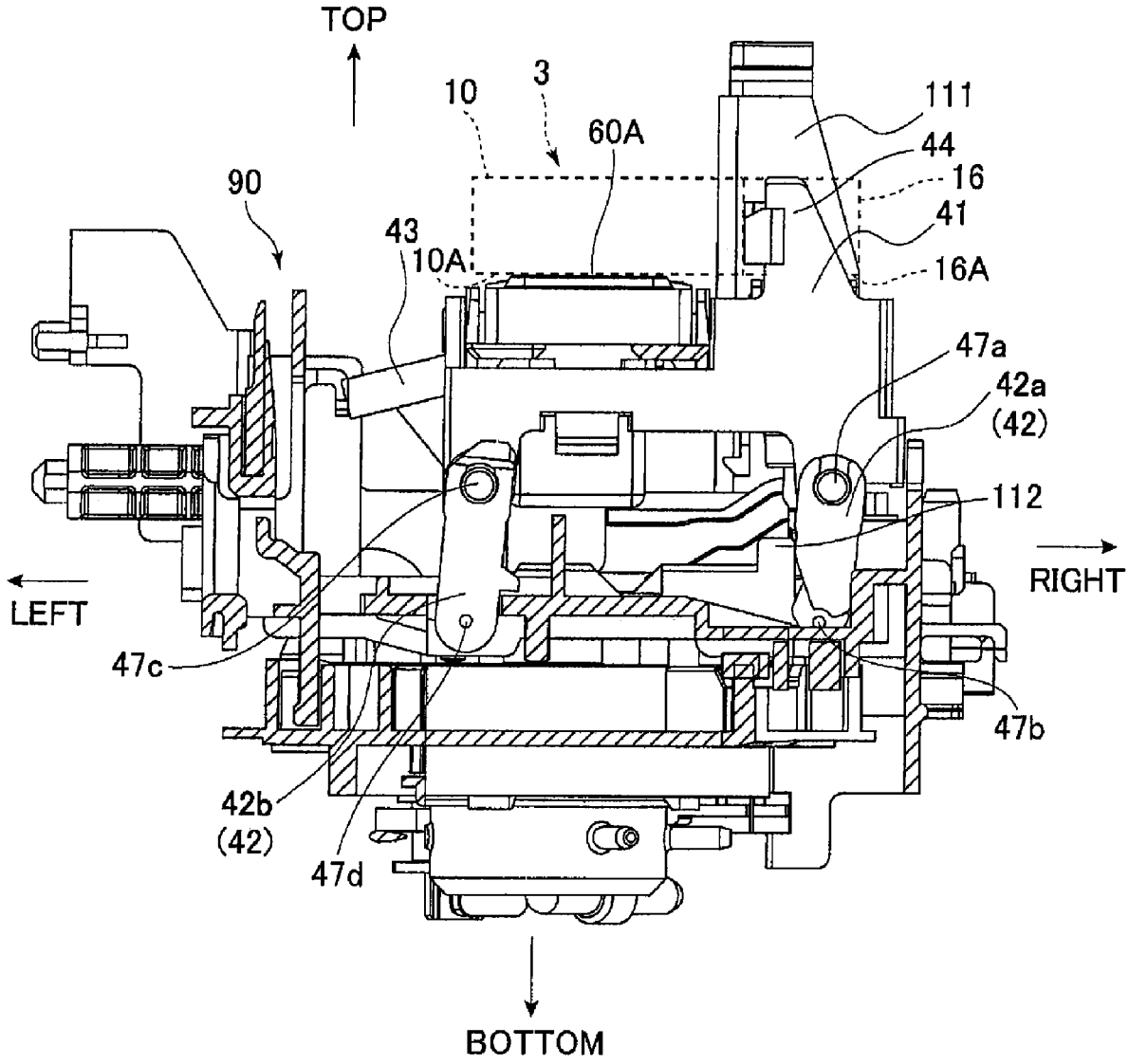
FIG. 12 is a cross-sectional view of the maintenance unit, revealing first and second link members when the cap lift holder is in the contact position.

FIG. 11 is a cross-sectional view of the maintenance unit 4, revealing the cap support part 112 when the cap lift holder 41 is in a contact position. FIG. 12 is a cross-sectional view of the maintenance unit 4, revealing the first and second link members 42*a* and 42*b* when the cap lift holder 41 is in the contact position.

Figure 13:
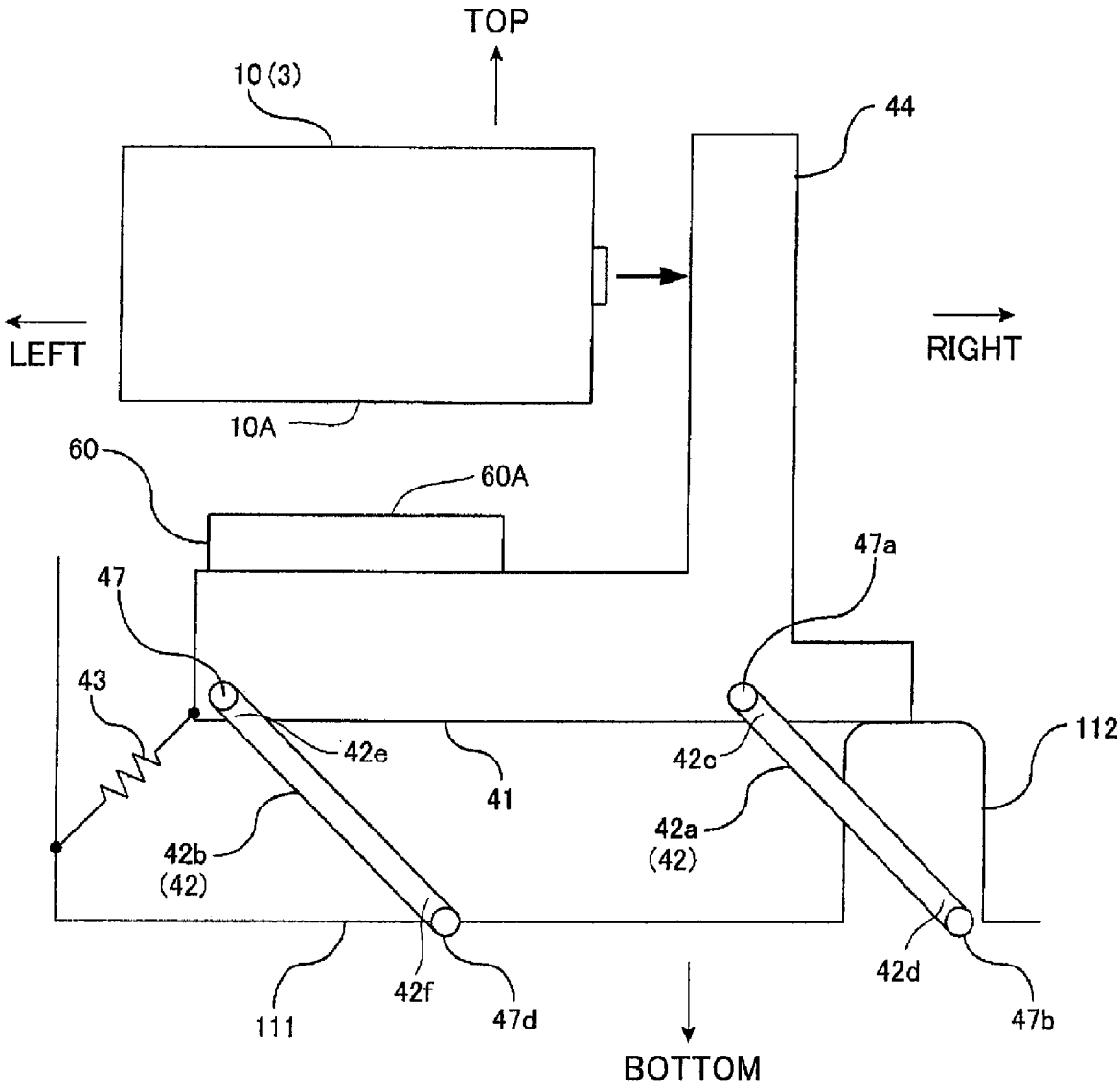
FIG. 13 is a schematic view of the maintenance unit according to the first embodiment of the present invention when the cap lift holder is in the standby position.
Figure 14:
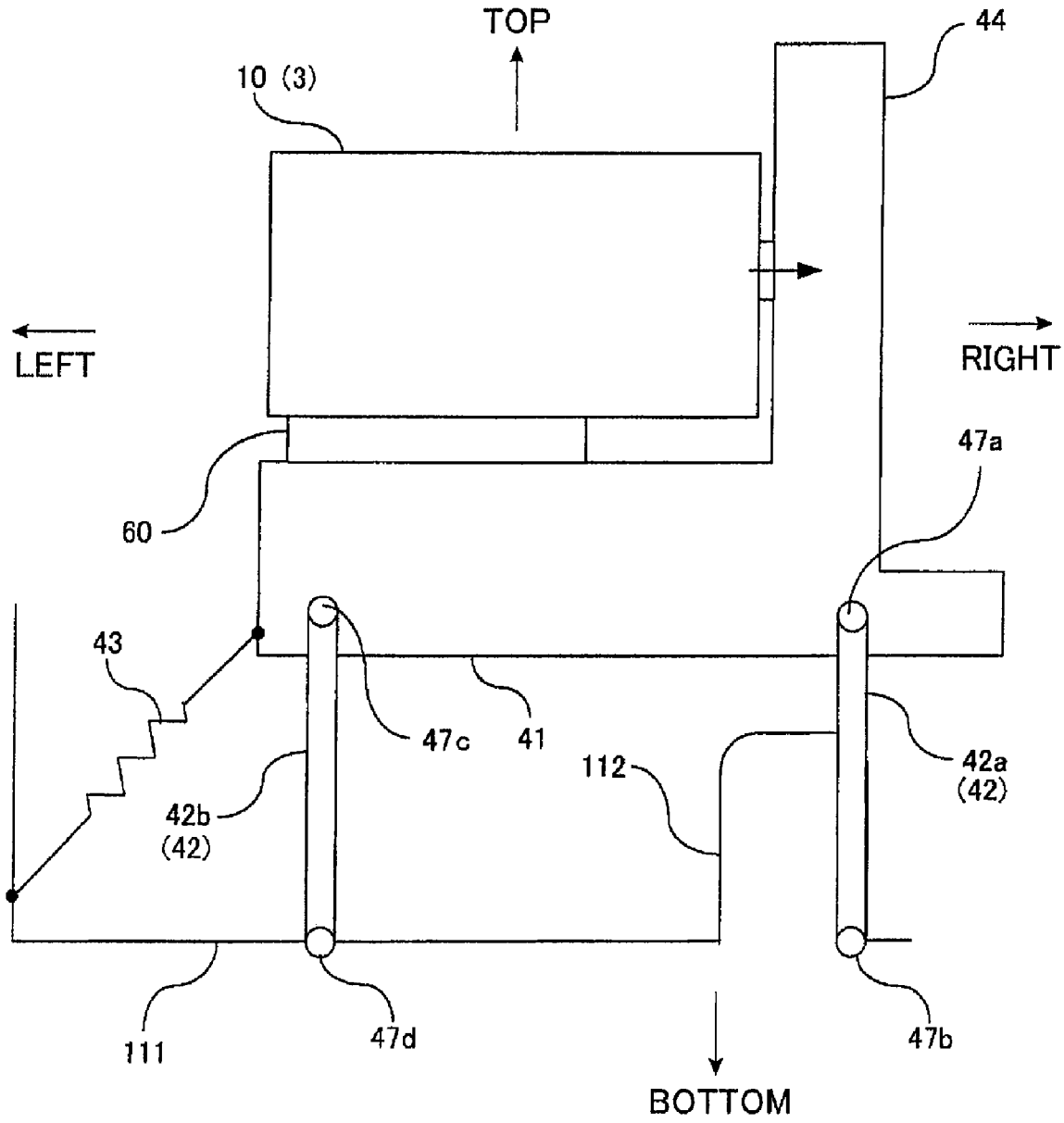
FIG. 14 is a schematic view of the maintenance unit according to the first embodiment of the present invention when the cap lift holder is in the contact position.

FIG. 13 shows a schematic view of the maintenance unit 4 when the cap lift holder 41 is in the standby position. FIG. 14 shows a schematic view of the maintenance unit 4 when the cap lift holder 41 is in the contact position.

The cap lift holder 41 is movably disposed on the maintenance frame 111. As shown in FIGS. 9-14, the cap lift holder 41 is engaged with the maintenance frame 111 by a four-joint linkage mechanism 42 configured of the two parallel first and second link members 42*a* and 42*b*. The first and second link members 42*a* and 42*b* have substantially the same length.

More specifically, the first link member 42*a* includes one end portion 42*c* and another end portion 42*d*. The one end portion 42*c* of the first link member 42*a* is pivotably fixed to the cap lift holder 41 on a first engaging part 47*a*. The another end portion 42*d* of the second link member 42*a* is pivotably fixed to the maintenance frame 111 on a first fixed part 47*b*.

The first engaging part 47*a* is positioned on the recording range 8 side (left side) of the first fixed part 47*b* when the cap lift holder 41 is in the standby position. The second link member 42*b* includes one end portion 42*e* and another end portion 42*f*. The one end portion 42*e* of the second link member 42*b* is pivotably fixed to the cap lift holder 41 on a second engaging part 47*c*. The another end portion 42*f* of the second link member 42*b* is pivotably fixed to the maintenance frame 111 on a second fixed part 47*d*. The second engaging part 47*c* is positioned on the recording range 8 side (left side) of the second fixed part 47*d* when the cap lift holder 41 is in the standby position. The second engaging part 47*c* is positioned on the recording range 8 side (left side) of the first engaging part 47*a*.

The first engaging part 47*a*, first fixed part 47*b*, second engaging part 47*c*, and second fixed part 47*d* are positioned so that the first and second link members 42*a* and 42*b* are parallel to each other when linked to these components.

The cap support part 112 provided on the maintenance frame 111 is disposed at the position of the first engaging part 47*a* or toward the point of origin side (right side) from the first engaging part 47*a*. The cap support part 112 supports a right lower end of the cap lift holder 41 when the cap lift holder 41 is in the standby position.

A pair of receiving plates 44 extend upward from a right edge of the cap lift holder 41 (see FIG. 6). As the carriage 3 moves from the recording range 8 toward the point of origin (the maintenance position 9), the recording heads 10 mounted on the carriage 3 contact the pair of receiving plates 44 from the left side just prior to arriving at the point of origin. At this state, a part of the carriage 3 corresponding to the valve case 16 is located between the pair of receiving plates 44. As the carriage 3 moves into the point of origin thereafter, the recording head 10 continually pushes the receiving plate 44.

As shown in FIGS. 9 through 12, the standby position of the cap lift holder 41 is located in a position lower than the contact position of the cap lift holder 41. The standby position of the cap lift holder 41 is on the left side in the maintenance frame 111. The contact position of the cap lift holder 41 is on the right side in the maintenance frame 111. The cap lift holder 41 is urged toward the standby position by a spring 43 (see FIG. 6).

<Nozzle Cap of the Maintenance Unit>

Next, the nozzle cap 60 of the maintenance unit 4 will be described with reference to FIGS. 9 and 11.

The nozzle cap 60 is provided on the cap lift holder 41 in a region to the left of an exhaust cap 40. The nozzle cap 60 is capable of moving vertically relative to the cap lift holder 41 through a spring (not shown). The nozzle cap 60 is formed of a silicon rubber in a rectangular shape extending in the front-to-rear direction (orthogonal to the surface of the drawing). Left and right recessed parts are formed in a top surface 60A of the nozzle cap 60. The top surface 60A of the nozzle cap 60 is substantially parallel to the bottom surface 10A of the recording head 10. Spacers 62 having a semicircle cross section and curved surfaces facing upward are accommodated in the two recessed parts.

When the cap lift holder 41 is in the standby position, the nozzle cap 60 is maintained at a lower height than the bottom surface 10A of the recording head 10. As the carriage 3 presses against the cap lift holder 41, moving the cap lift holder 41 upward and rightward toward the contact position, rib parts formed on the upper edges of the nozzle cap 60 contact the bottom surface 10A of the recording head 10 to form an airtight state that is enhanced by the urging force of the spring (not shown).

Through this contact, the top surfaces of the spacers 62 provided on the nozzle cap 60 and the bottom surface 10A of the recording head 10 simultaneously configure independent left and right hermetically sealed spaces that are in communication with the nozzles in the recording head 10 (see FIG. 11). The narrow space on the left side is a black hermetically sealed space corresponding to the black nozzles, while the wider space on the right side is a color hermetically sealed space corresponding to the nozzles for the three colors.

As shown in FIG. 4, an inlet 64 is formed in the bottom wall of the nozzle cap 60 for each recessed part. The inlet 64 formed in a narrow black recessed part (the left recessed part) is connected to a black ink port 79 of a switching device 70 shown in FIG. 7 via a tube (not shown). The inlet 64 for a wide color recessed part (the right recessed part) is connected to a color port 80 of the switching device 70 via another tube.

Each hermetically sealed space is formed such that the vertical clearance is smallest in the left-to-right center and gradually increases toward both left and right sides. Accordingly, when the hermetically sealed space is set to a negative pressure to draw ink from the nozzles through the inlet 64 by the rotary pump 38, a flow of air (including ink) from the left-to-right center toward both left and right sides having a smaller flow resistance is produced substantially uniformly across the front-to-rear direction. This airflow combines with the flow in the left and right sides of the hermetically sealed space to produce a larger flow toward the inlet 64, thereby drawing air into the inlet 64.

Hence, even when the inlet 64 is provided on the front end of the hermetically sealed space elongated in the front-to-rear direction, a uniform airflow is produced across the entire range so that ink can be purged uniformly from all nozzles.

Further, as shown in FIG. 9, the wiper 90 is provided to the left of the cap lift holder 41 for wiping ink deposited on the bottom surface 10A of the recording head 10.

<Operations of the Cap Lift Holder>

Next, the operations of the maintenance unit 4 during movement of the carriage 3 will be described with reference to FIGS. 13 and 14.

As shown in FIG. 13, the urging force of the return spring 43 holds the cap lift holder 41 in the standby position. In this state, when the carriage 3 moves from the recording range 8 side toward the point of origin, the recording head 10 contacts the receiving plate 44 of the cap lift holder 41. At the same time, the part of the carriage 3 corresponding to the valve case 16 is located between the pair of receiving plates 44.

At this point, both the exhaust cap 40 and the nozzle cap 60 are positioned below the bottom surface 10A of the recording head 10 and, hence, do not contact (are separated from) the bottom surface 10A of the recording head 10.

As the recording head 10 moves toward the point of origin (right side) from this state, the cap lift holder 41 supported by the first and second link members 42*a* and 42*b* begins to move upward to the right. At this time, depending on the lengths of the two link members 42*a* and 42*b* and the positions of the first and second engaging parts 47*a* and 47*c* when the cap lift holder 41 is in the standby position, a pushing force in a direction downward to the left could be applied to the first engaging part 47*a*, while a pulling force in a direction upward to the right could be applied to the second engaging part 47*c*.

In this situation, the first link member 42*a* is pushed downward, preventing the cap lift holder 41 from moving upward to the right. Accordingly, the cap lift holder 41 could become immovably stuck in an inclined position/state. In a worst case, the cap lift holder 41 could become unable to return to its original position/state.

However, since the lower right edge of the cap lift holder 41 is supported on the cap support part 112, as shown in FIG. 13, the first link member 42*a* is not pushed downward by the pushing force applied to the first engaging part 47*a*. Hence, the cap lift holder 41 can be maintained at a uniform height from the first fixed part 47*b* on the maintenance frame 111.

When the recording head 10 moves further toward the point of origin while the cap lift holder 41 supported on the cap support part 112 at the lower right edge thereof is maintained at this uniform height from the maintenance frame 111, a pulling force in a direction upward to the right begins to be applied to the first engaging part 47*a*.

Specifically, since the cap support part 112 is disposed at the position of the first engaging part 47*a* or nearer to the point of origin than the first engaging part 47*a*, the first link member 42*a* cannot be pushed downward. Therefore, the recording head 10 can move toward the point of origin. As the recording head 10 moves farther toward the point of origin, a pulling force upward to the right becomes applied to both the first and second engaging parts 47*a* and 47*c*, thereby reliably moving the cap lift holder 41 along an arcing path upward to the right so that the cap lift holder 41 is moved to the contact position. Since the pulling force is applied to the first and second engaging parts 47*a* and 47*c*, the cap lift holder 41 can be moved from the standby position to the contact position without changing in the orientation of the cap lift holder 41

When the cap lift holder 41 moves to the contact position, the nozzle cap 60 contacts the bottom surface 10A of the recording head 10 from the bottom thereof. As the carriage 3 moves farther rightward, the pushing spring (not shown) provided between the upward moving cap lift holder 41 and the nozzle cap 60 contacting the bottom surface 10A of the recording head 10 elastically contracts. An elastic restoring force of the pushing spring pushes the nozzle cap 60 firmly against the recording head 10, as shown in FIG. 11, producing a reliable hermetically sealed space between the bottom surface 10A and the nozzle cap 60.

As the carriage 3 continues to move rightward and arrives at the point of origin, the exhaust cap 40 contacts the bottom surface 16A of the valve case 16, as shown in FIG. 11, and the elastic force of a spring (not shown) provided between the exhaust cap 40 and the cap lift holder 41 pushes the exhaust cap 40 firmly against the bottom surface 16A of the valve case 16. As a result, a reliable hermetically sealed space is formed between the bottom surface 16A of the valve case 16 and the exhaust cap 40.

Effects of the First Embodiment

With the maintenance unit 4 having the structure described above, the top surface 60A of the nozzle cap 60 provided on the cap lift holder 41 is substantially parallel to the bottom surface 10A and is substantially orthogonal to the direction in which ink is ejected from the nozzles when in the standby position and the cap lift holder 41 can be moved from the standby position to the contact position without changes in the orientation of the cap lift holder 41. Accordingly, the top surface 60A of the nozzle cap 60 can easily seal the nozzles in the bottom surface 10A while substantially orthogonal to the direction of ink ejection.

Since the nozzles can be sealed with the top surface 60A oriented substantially orthogonal to the direction of ink ejection, an excellent seal can be formed between the nozzles and the nozzle cap 60. Further, since the nozzle cap 60 does not contact the nozzles in a transverse direction (in a parallel direction with respect to the top surface 60A) to the nozzles, the nozzle cap 60 does not damage the nozzles.

The cap support part 112 is provided closer to the point of origin than the first engaging part 47*a* in the standby position. Accordingly, the cap lift holder 41 is supported on the cap support part 112 even when a force toward the first fixed part 47*b* is applied to the first engaging part 47*a*. Therefore, since the cap lift holder 41 does not move farther downward toward the maintenance frame 111, the cap lift holder 41 does not become immovably stuck in the inclined position/state.

Since the cap lift holder 41 does not become immovably stuck in the inclined position/state, the recording head 10 can move farther toward the point of origin. As the recording head 10 moves farther toward the point of origin while the cap lift holder 41 is supported on the cap support part 112, a force pushing the first engaging part 47*a* away from the maintenance frame 111 is applied to the first engaging part 47*a*, ultimately enabling the cap lift holder 41 to move toward the recording head 10. As a result, the nozzle cap 60 of the cap lift holder 41 can seal the nozzles.

Hence, the maintenance unit 4 having this construction can reliably seal the nozzles in the recording head 10, regardless of the positions of the first and second engaging parts 47*a* and 47*c* relative to a direction orthogonal to the moving direction of the recording head 10.

In other words, the first and second engaging parts 47*a* and 47*c* can be positioned near the recording head 10 when the in the cap lift holder 41 is in the standby position, reducing the required lengths of the link members 42*a* and 42*b*. Consequently, the maintenance unit 4 can be made more compact.

Further, since the maintenance unit 4 can be made more compact, the inkjet printer 101 incorporating the maintenance unit 4 can also be made more compact.

Further, in the maintenance unit 4, since the cap lift holder 41 does not become immovably stuck in the inclined position/state as the cap lift holder 41 moves, an excessive load is not placed on a motor or other driving device provided for driving the carriage 3 mounted on the recording head 10 as the recording head 10 pushes the cap lift holder 41. Hence, a smaller motor can be used for driving the carriage 3, which can also lead to a more compact inkjet printer 101. Further, this configuration can extend the life of the driving device.

Further, since the cap lift holder 41 can move smoothly toward the contact position as the recording head 10 moves toward the point of origin, a small amount of energy is required for moving the cap lift holder 41. More specifically, the driving device for driving the carriage does not require a large force for moving the carriage 3 to the point of origin, enabling the carriage 3 to be provided with a small driving device having a low output.

Second Embodiment

Next, a second embodiment of the present invention will be described with reference to FIG. 15. Since the structure of the inkjet printer according to the second embodiment resembles that described in the first embodiment, like parts and components have been designated with the same reference numerals to avoid duplicating description.

Figure 15:
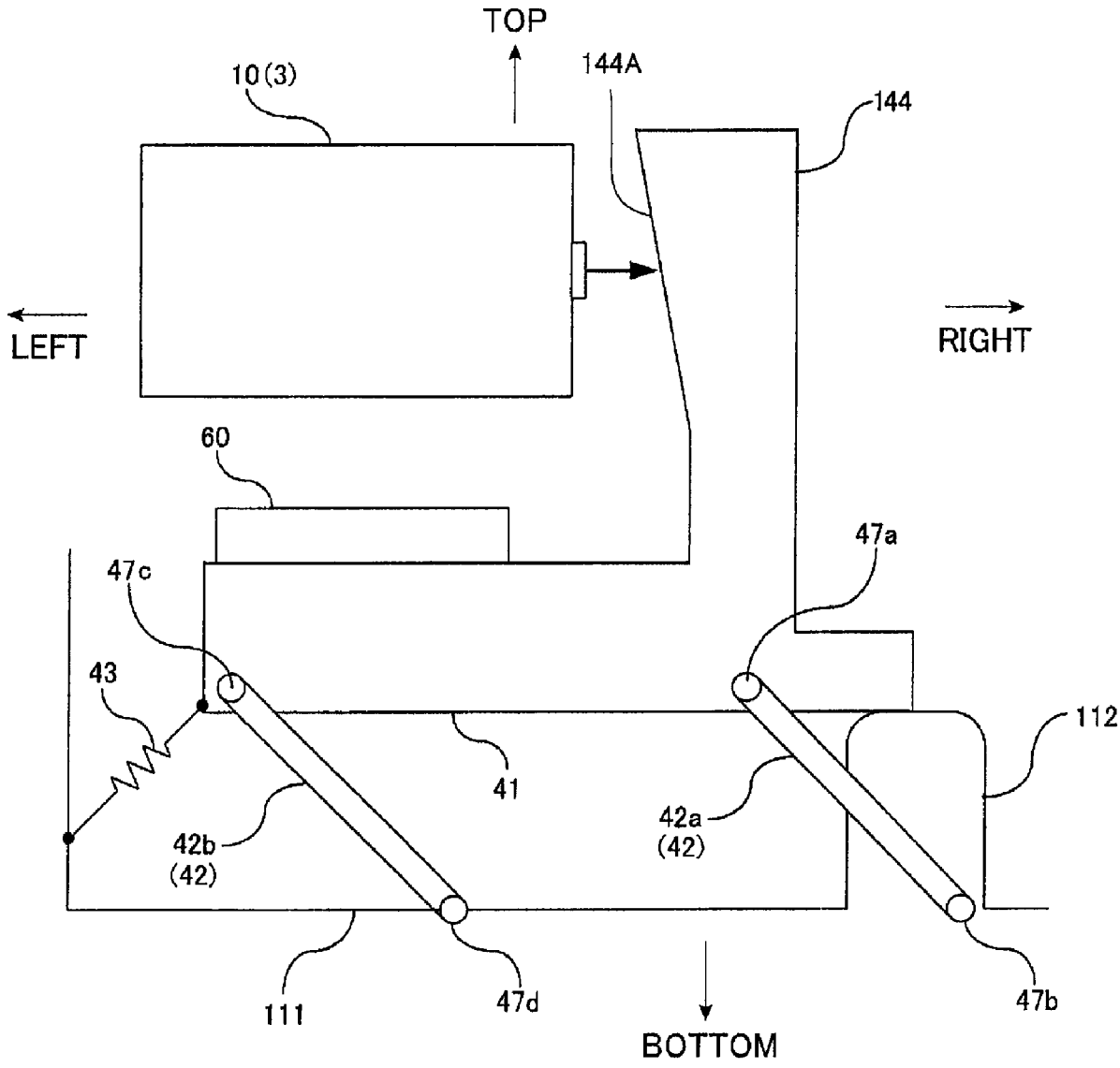
FIG. 15 is a schematic view of a maintenance unit according to a second embodiment of the present invention.

FIG. 15 is a schematic view showing the state of the cap lift holder 41 in the standby position. As shown in FIG. 15, a receiving plate 144 corresponding to the receiving plate 44 in the first embodiment has a sloped surface 144A inclined with respect to the vertical direction from a center portion of the receiving plate 144 in the vertical direction to an upper edge of the receiving plate 144. The sloped surface 144A is inclined gradually leftwardly toward the top side and faces the recording head 10.

By sloping the sloped surface 144A of the receiving plate 144 of the cap lift holder 41 toward the recording head 10 in this way, the recording head 10 contacts the sloped surface 144A when moving toward the point of origin.

Since the sloped surface 144A is inclined gradually leftwardly toward the top side in FIG. 15, contact by the recording head 10 generates a partial force upward to the right in FIG. 15 on the sloped surface 144A of the receiving plate 144. This partial force in the direction upward to the right is applied to the first and second engaging parts 47*a* and 47*c* as a pulling force in the direction upward to the right.

When this pulling force is applied to the first and second engaging parts 47*a* and 47*c*, the cap lift holder 41 can move smoothly toward the contact position as the recording head 10 moves toward the point of origin. Accordingly, the cap lift holder 41 does not become immovably stuck in the inclined position/state.

In other words, as with the cap lift holder 41 of the first embodiment, it is possible to move the cap lift holder 41 smoothly from the standby position to the contact position, regardless of the length of the two link members 42*a* and 42*b*. Hence, the link members 42*a* and 42*b* can be shortened to reduce the size of the maintenance unit 4.

Further, since the maintenance unit 4 can be made more compact, the inkjet printer 101 incorporating the maintenance unit 4 can also be made more compact.

Further, in the maintenance unit 4, since the cap lift holder 41 does not become immovably stuck in the inclined position/state as the cap lift holder 41 moves, an excessive load is not placed on the motor or other driving device provided for driving the carriage 3 mounted on the recording head 10 as the recording head 10 pushes the cap lift holder 41. Hence, a smaller motor can be used for driving the carriage 3, which can also lead to a more compact inkjet printer 101.

Variations of the Embodiments

While the invention has been described in detail with reference to specific embodiments thereof, it would be apparent to those skilled in the art that many modifications and variations may be made therein without departing from the spirit of the invention, the scope of which is defined by the attached claims.

Figure 16A:
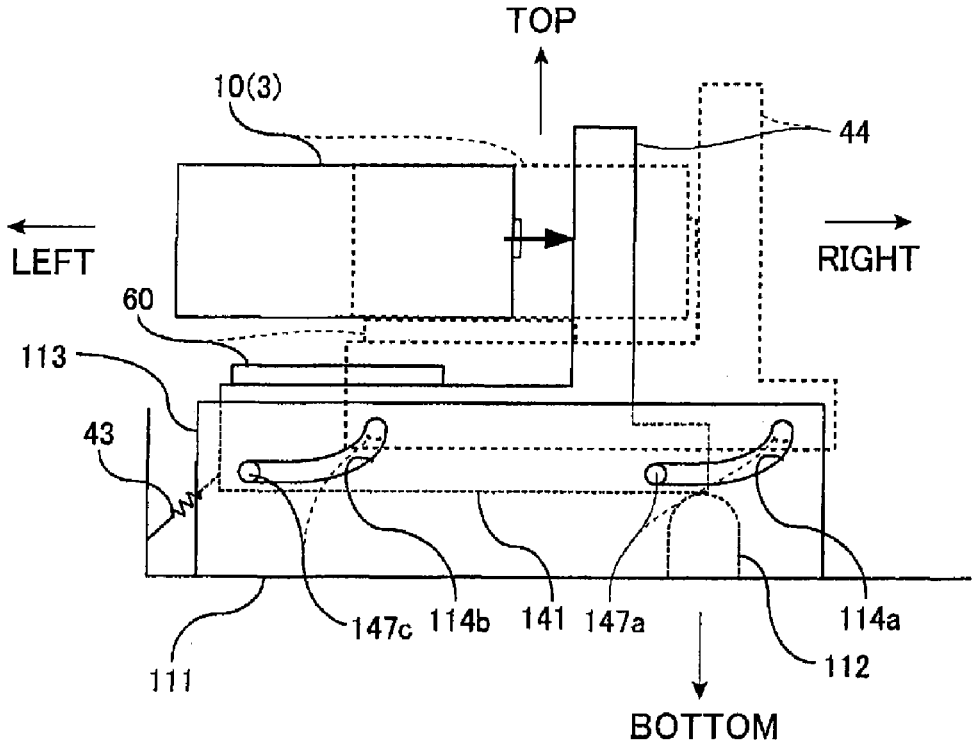
FIG. 16A is a schematic view of a maintenance unit according to one variation of an embodiment of the present invention.

For example, a four-joint parallel linkage mechanism is used in the embodiments described above to move the cap lift holder 41 from the standby position to the contact position. However, a cam mechanism may be used in place of the linkage mechanism. More specifically, as shown in FIG. 16A, wall parts 113 are provided on the maintenance frame 111 on either side of a cap lift holder 141 corresponding to the cap lift holder 41 in the embodiments described above. The wall parts 113 each are formed with guiding grooves 114*a* and 114*b*.

First and second engaging parts 147*a* and 147*c* corresponding to the first and second engaging parts 47*a* and 47*c* in the embodiments described above are provided in shape of bosses that protrude out from the cap lift holder 41. The first engaging part 147*a* is inserted into the guiding groove 114*a*, while the second engaging part 147*c* is inserted into the guiding groove 114*b*. As with the embodiments described above, the cap support part 112 supports a right lower end of the cap lift holder 41 when the cap lift holder 41 is in the standby position.

As with the four-joint parallel linkage mechanism 42 in the embodiments described above, this construction can move the cap lift holder 41 via the guiding grooves 114*a* and 114*b* from the standby position to the contact position. Accordingly, the cap lift holder 41 does not become immovably stuck in the inclined position/state.

Figure 16B:
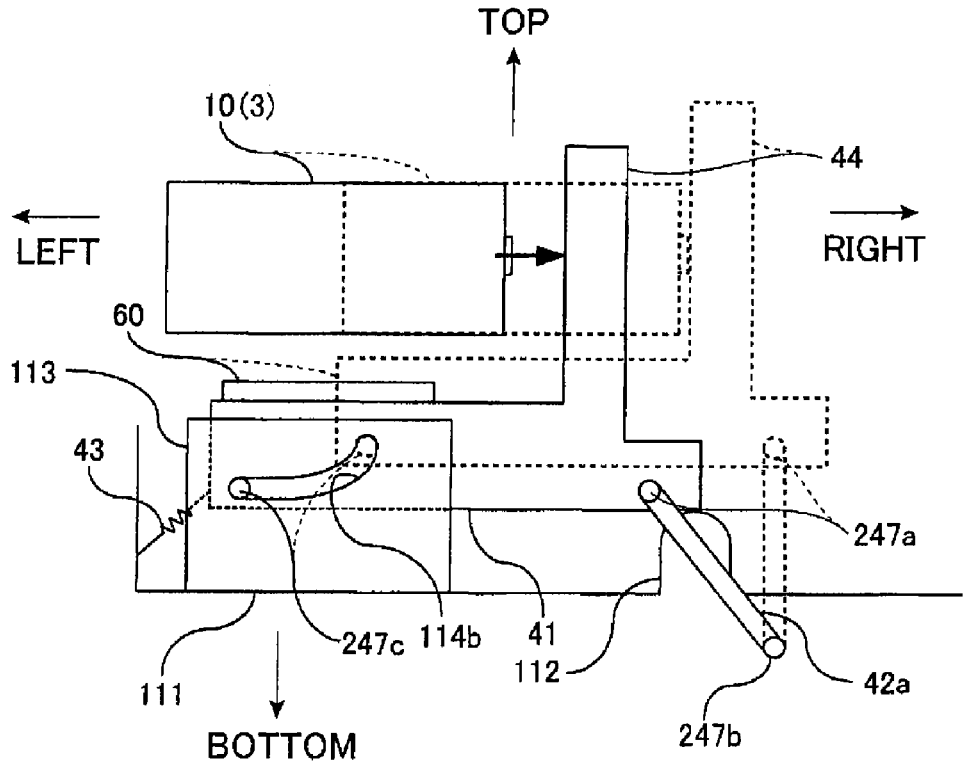
FIG. 16B is a schematic view of a maintenance unit according to another variation of an embodiment of the present invention.

Alternatively, it is possible to combine the cam mechanism and linkage mechanism, as shown in FIG. 16B. Specifically, a link member 242*a* corresponding to the first link member 42*a* in the embodiments described above is engaged with the cap lift holder 41 and the maintenance frame 111 at a first engaging part 247*a* and a first fixed part 247*b*, while a second engaging part 247*c* corresponding to the second engaging part 147*c* in FIG. 16A is formed as a boss and is inserted through the guiding groove 114*b* formed in the wall parts 213 of the maintenance frame 111.

As with the four-joint parallel linkage mechanism in the embodiments described above, this construction can also move the cap lift holder 41 via the first link member 42*a* and the guiding groove 114*b* from the standby position to the contact position. Accordingly, the cap lift holder 41 does not become immovably stuck in the inclined position/state.

Further, in each of the embodiments described above, the cap support part 112 is provided on the maintenance frame 111. However, the same effects can be achieved by providing the cap support part 112 on the cap lift holder 41.

In the preferred embodiments described above, the droplet ejecting device is applied to an inkjet printer. However, the droplet ejecting device may also be a lens manufacturing apparatus or the like. In such a case, liquid resin may be used in place of the ink and a resin board in place of the recording medium, for example. The lens manufacturing device can produce resin lenses by ejecting the liquid resin from the recording head 10 onto the resin board to form convex or concave surfaces thereon.

Various droplet ejecting devices can be configured to eject a liquid stored in subtanks as droplets from the nozzles, as in a soldering apparatus for automatically soldering various printed circuit boards or the like by ejecting molten solder from the nozzles, apparatuses that form an organic film used to produce organic EL displays by ejecting an organic polymer material (illuminant) according to the inkjet method, or apparatuses for ejecting resin in a slurry form from the nozzles.

What is claimed is:

1. A maintenance unit for a droplet ejecting device, comprising:

a base frame;

a sealing unit that is provided on the base frame and capable of sealing nozzles formed in a droplet ejecting head mounted on a carriage, the carriage reciprocating between a droplet ejecting region for ejecting droplets from the nozzles in the droplet ejecting head onto a recording medium and a maintenance region for cleaning the nozzles in the droplet ejecting head, the sealing unit being located on the maintenance region;

a guiding mechanism that is interposed between the base frame and the sealing unit and capable of moving the sealing unit in association with a reciprocating motion of the carriage between a first position in which the sealing unit seals the nozzles and a second position in which the sealing unit separates from the nozzles, the guiding mechanism including a first engaging part and a second engaging part, wherein the first and second engaging parts are coupled to the sealing unit, the second engaging part being provided at a side closer to the droplet ejecting region than the first engaging part, the first and second engaging parts being movable according to positions of the sealing unit; and a supporting part that is interposed between the sealing unit and the base frame and comprises a contact surface that contacts the sealing unit when the sealing unit is in the second position, wherein the contact surface is positioned at a side farther from the droplet ejecting region than the first engaging part when the sealing unit is in the second position and is positioned at a side closer to the droplet ejecting region than the first engaging part when the sealing unit is in the first position.

2. The maintenance unit according to claim 1, wherein the guide mechanism is a linkage mechanism comprising a pair of link members, one end of one link member being pivotably engaged with the sealing unit at the first engaging part, another end of the one link member being pivotably engaged with the base frame, one end of another link member being pivotably engaged with the sealing unit at the second engaging part, another end of the another link member being pivotably engaged with the base frame.

3. The maintenance unit according to claim 2, wherein the pair of link members is movable while maintaining a parallel relation with each other in association with the movement of the sealing unit between the first position and the second position.

4. The maintenance unit according to claim 3, wherein the sealing unit is movable while maintaining a parallel relation with the base frame when the sealing unit is moved between the first position and the second position.

5. The maintenance unit according to claim 1, wherein the sealing unit includes a contact portion upon which the carriage impinges when the carriage moves from the droplet ejecting region to the maintenance region, the sealing unit being moved from the second position to the first position while being guided by the guiding mechanism when the carriage impinges upon the contact portion and apply push force thereupon.

6. The maintenance unit according to claim 1, wherein the sealing unit includes a contact portion upon which the carriage impinges when the carriage moves from the droplet ejecting region to the maintenance region, the contact portion being configured to apply pushing force to the sealing unit in a direction from the second position to the first position when the carriage impinges upon the contact portion and apply push force thereupon.

7. The maintenance unit according to claim 6, wherein the contact portion has a sloped surface inclined toward the droplet ejecting region and facing the droplet ejecting head.

8. A droplet ejecting device comprising:

a droplet ejecting head that has nozzles for ejecting droplets;

a carriage that supports the droplet ejecting head and reciprocates between a droplet ejecting region for ejecting droplets onto a recording medium and a maintenance region for cleaning the nozzles;

a recording medium moving unit that moves the recording medium in a direction substantially orthogonal to a reciprocating direction of the carriage; and a maintenance unit comprising:

a base frame;

a sealing unit that is provided on the base frame and is capable of sealing nozzles formed in the droplet ejecting head, the sealing unit being located on the maintenance region;

a guiding mechanism that is capable of moving the sealing unit in association with a reciprocating motion of the carriage between a first position in which the sealing unit seals the nozzles and a second position in which the sealing unit separates from the nozzles, the guiding mechanism including a first engaging part and a second engaging part, wherein the first and second engaging parts are coupled to the sealing unit, the second engaging part being provided at a side closer to the droplet ejecting region than the first engaging part, the first and second engaging parts being movable according to positions of the sealing unit; and a supporting part that is interposed between the sealing unit and the base frame and comprises a contact surface that contacts the sealing unit when the sealing unit is in the second position, wherein the contact surface is positioned at a side farther from the droplet ejecting region than the first engaging part when the sealing unit is in the second position and is positioned at a side closer to the droplet ejecting region than the first engaging part when the sealing unit is in the first position.

9. The droplet ejecting device according to claim 8, wherein the guide mechanism is a linkage mechanism comprising a pair of link members, one end of one link member being pivotably engaged with the sealing unit at the first engaging part, another end of the one link member being pivotably engaged with the base frame, one end of another link member being pivotably engaged with the sealing unit at the second engaging part, another end of the another link member being pivotably engaged with the base frame.

10. The droplet ejecting device according to claim 9, wherein the pair of link members is movable while maintaining a parallel relation with each other in association with the movement of the sealing unit between the first position and the second position.

11. The droplet ejecting device according to claim 10, wherein the sealing unit is movable while maintaining a parallel relation with the base frame when the sealing unit is moved between the first position and the second position.

12. The droplet ejecting device according to claim 8, wherein the sealing unit includes a contact portion upon which the carriage impinges when the carriage moves from the droplet ejecting region to the maintenance region, the sealing unit being moved from the second position to the first position while being guided by the guiding mechanism when the carriage impinges upon the contact portion and apply push force thereupon.

13. The droplet ejecting device according to claim 8, wherein the sealing unit includes a contact portion upon which the carriage impinges when the carriage moves from the droplet ejecting region to the maintenance region, the contact portion being configured to apply pushing force to the sealing unit in a direction from the second position to the first position when the carriage impinges upon the contact portion and apply push force thereupon.

14. The droplet ejecting device according to claim 13, wherein the contact portion has a sloped surface inclined toward the droplet ejecting region and facing the droplet ejecting head.

* * * * *